US005119865A

United States Patent [19]

Mae et al.

[11] Patent Number: 5,119,865

[45] Date of Patent: Jun. 9, 1992

[54] CU-ALLOY MOLD FOR USE IN CENTRIFUGAL CASTING OF TI OR TI ALLOY AND CENTRIFUGAL-CASTING METHOD USING THE MOLD

[75] Inventors: Yoshiharu Mae; Tsutomu Oka, both of Saitama, Japan

[73] Assignee: Mitsubishi Materials Corporation, Tokyo, Japan

[21] Appl. No.: 645,969

[22] Filed: Jan. 24, 1991

[30] Foreign Application Priority Data

Feb. 20, 1990 [JP] Japan ..... 2-39360
Mar. 27, 1990 [JP] Japan ..... 2-78384

[51] Int. Cl.[5] ..... B22D 13/00; B22D 13/10

[52] U.S. Cl. ..... 164/114; 164/138; 164/286; 164/290

[58] Field of Search ..... 164/114, 138, 286, 289, 164/290, 296

[56] References Cited

U.S. PATENT DOCUMENTS 1,320,744 11/1919 Lavaud ..... 164/296
2,811,757 11/1957 Banister .
3,099,044 7/1963 Reuter ..... 164/290
4,377,424 3/1983 Hirao et al. ..... 164/418
4,883,112 11/1989 Gravemann ..... 164/459

FOREIGN PATENT DOCUMENTS 2154615 5/1973 Fed. Rep. of Germany .
3725755 2/1989 Fed. Rep. of Germany .

OTHER PUBLICATIONS

O. W. Simmons "A Method of Centrifugally Casting Titanium", Metal Progress 63 (Mar. 1953) 3, 72 e.v.

*Primary Examiner*—Richard K. Seidel
*Attorney, Agent, or Firm*—Oblon, Spivak, McClelland, Maier & Neustadt

[57] ABSTRACT

In a Cu-alloy mold for use in centrifugal casting of Ti or Ti-alloys, the mold body is made of a Cu alloy satisfying the following relationship:

$$Ts + 0.3\rho \geqq 70$$

where Ts is the tensile strength (kg/mm$^2$), and $\rho$ is the electrical conductance (% IACS). A cavity disposed in the mold body has a volume which is at most 30% of the volume of the mold body. Also disclosed is a method for centrifugally casting Ti or Ti-alloy by the use of the above-described mold.

15 Claims, 2 Drawing Sheets

CU-ALLOY MOLD FOR USE IN CENTRIFUGAL CASTING OF TI OR TI ALLOY AND CENTRIFUGAL-CASTING METHOD USING THE MOLD

BACKGROUND OF THE INVENTION

The present invention relates to a Cu-alloy mold for use in centrifugal casting of Ti and Ti alloys superior in dimensional accuracy, and to a centrifugal casting method using the mold.

Ti or Ti alloy has widely been used in many fields as Ti or Ti-alloy castings, because of their superior corrosion resistance and specific strength.

Ti or Ti alloys cannot be cast in normal or usual foundry sand molds, because they are chemically active. For this reason, for casting Ti or Ti alloys, used are a graphite mold, a precision casting mold, utilizing specific ceramics, typically represented by a lost-wax process, and the like. Further, a water-cooled Cu mold or the like is also used for casting of the Ti or Ti alloy.

However, the above-described graphite mold is expensive, and lacks dimensional precision. Furthermore, since the precision casting mold represented by the lost-wax process must employ expensive ceramics, use of the precision casting mold increases the cost of production.

On the other hand, the water-cooled mold is a mold which is most suitable for mass production as a general continuous casting mold. Casting of the Ti or Ti alloy by the use of the water-cooled mold is considered to enable Ti or Ti-alloy castings superior in dimensional precision, to be produced. However, the following problems arise. That is, if the water-cooled mold is to be used as a centrifugal casting mold, it is difficult to construct water-cooling mechanisms because the latter is rotated during the centrifugal casting. If molten Ti or molten Ti alloy is cast in the Cu mold without water cooling, the Cu mold is considered to be heated to temperatures in excess of the heat-resistant temperature. For this reason, melting loss or seizure will occur on a surface of a cavity in the Cu mold into which the Ti or Ti alloy is cast. Further, breakage or deformation will occur in the Cu mold body due to thermal stresses. Thus, it is impossible to produce Ti or Ti-alloy castings which are superior in dimensional accuracy.

Apart from the above, where a precision product made of a titanium alloy is to be manufactured, it is general that, since the titanium alloy is high in melting point and is reactive, a mold made of ceramics is used to cast the product.

Where relatively small components, for example, valve heads or the like used in engines are mass produced, of a titanium alloy, the following method has been taken. That is, in the method, a plurality of molds made of ceramics each having a plurality of molding cavities are stacked one upon the other vertically in a manner of a plurality of stages or steps, and the molds are rotated about a vertical central axis (truck) to cause a centrifugal force to act upon molten metal within the cavities, thereby spreading the molten metal to every nook and corner of the cavities (branches), to form the valve heads. By this method, a cast intermediate article is produced in which the plurality of valve heads are molded at forward-end portions of the branches.

The reason why the aforesaid casting method can be carried into practice is that, after casting, the molds made of ceramics are disposable.

The inventors of this application have considered that, in place of the throw away ceramic molds, copper alloy molds usable repeatedly should be used to cast titanium-alloy products.

The copper alloy molds when used as described above, the following problems arise. That is, when the products are to be taken out after casting, even if each of the molds is made as a book mold, the mold halves will interfere with a cast article. Thus, the mold halves cannot be opened sufficiently to take out the products.

Furthermore, generally, an engine valve made of a titanium alloy is light and strong or tough and, accordingly, such valves are employed in high r.p.m. engines for racing cars. Particularly, the engine valve made of the titanium alloy, which is used as an exhaust valve, can be heated to temperatures of the order of 700° C. by exhaust gas. In view of this, as shown in FIG. 4 of the attached drawings, the following method has been proposed. That is, a valve head 100 is made of a titanium alloy which has the following composition:

Al: 5.5 to 6.5 wt %,
Sn: 1.8 to 2.2 wt %,
Zr: 3.6 to 4.4 wt %,
Mo: 1.8 to 2.2 wt %,
Si: equal to or less than 0.10 wt %, and
the remainder: Ti and unavoidable impurities.

The above-described titanium alloy will hereunder be referred to as "Ti-6Al-2Sn-4Zr-2Mo-0.1Si alloy".

On the other hand, a valve stem 200 is made of a titanium alloy which is superior in processability and which has the following composition:

Al: 5.5 to 6.75 wt %,
V: 3.5 to 4.5 wt %,
Fe: equal to or less than 0.30 wt %, and
the remainder: Ti and unavoidable impurities.

The above-mentioned titanium alloy will hereunder be referred to as "Ti-6Al-4V alloy".

The valve head 100 and the valve stem 200 are joined together by a friction welding process or the like, to manufacture an engine valve 300 made of the titanium alloy.

Since the valve stem 200 is made of the Ti-6Al-4V alloy which is superior in processability, it is possible to easily manufacture the valve stem 200 by plastic processing. Since, however, the valve head 100 is made of the Ti-6Al-2Sn-4Zr-2Mo-0.1Si alloy which is inferior in processability, the valve head 100 has been manufactured such that the alloy is melted in a plasma-arc furnace and, subsequently, is centrifugally cast by the use of a graphite permanent mold.

Without being limited to the racing engines, the engine weight has been reduced in recent years, and the engine speed had tended to increase. In keeping with this, a valve head section of the exhaust valve is heated to a temperature exceeding 800° C. High-temperature strength is insufficient in the conventional valve head made of Ti-6Al-2Sn-4Zr-2Mo-0.1Si-alloy casting. Thus, there is a problem in durability. If the Al content increases in the titanium alloy, the tensile strength and the 0.2% proof stress increase. However, there is a tendency that elongation is reduced. Particularly, it has been known that elongation at normal temperature is excessively reduced.

Accordingly, the exhaust valve, which has the valve head made of the titanium alloy rich in Al content, has no problem in use at high temperature. If, however, the exhaust valve is used at the normal temperature, for example, if the exhaust valve receives a shock like in the start-up of the engine, there may be a case where cracks or breaking loss occur in parts of the valve head, because of its brittleness. Thus, there is a problem that the valve head cannot be put into practical use.

SUMMARY OF THE INVENTION

It is an object of the invention to provide a Cu-alloy mold which can be used in centrifugal casting of Ti or Ti-alloy castings, which provides castings of high dimensional accuracy, in quantities larger than, and at a lower cost than the conventionally prepared castings.

It is another object of the invention to provide a method of centrifugally casting Ti and Ti-alloys by the use of the above-mentioned Cu-alloy mold.

It is still another object of the invention to provide a mold apparatus in which, even in a plurality of molds which are not discarded after use, it is possible to practice, a casting method in which the plurality of molds are stacked one upon the other vertically in stages or steps.

It is another object of the invention to provide a method of manufacturing an engine valve head made of a titanium alloy, which is superior in mechanical properties at the normal and high temperatures, particularly, in shock resistance at the normal temperature.

According to the invention, there is provided a Cu-alloy mold for use in centrifugal casting of Ti and Ti-alloys, comprising a mold body having defined therein a cavity, wherein the mold body is made of a Cu alloy satisfying the following relationship:

$$Ts+0.3\rho \geqq 70$$

where Ts is the tensile strength (kg/mm$^2$), and $\rho$ is the electrical conductance (% IACS), and wherein the cavity volume is at most 30% of the volume of the mold body.

According to the invention, there is also provided a method of centrifugally casting Ti and Ti-alloys by the use of a Cu-alloy mold which comprises a mold body having defined therein a cavity, wherein the mold body is made of a Cu alloy satisfying the following relationship:

$$Ts+0.3\rho \geqq 70 \quad (1)$$

where Ts is the tensile strength (kg/mm$^2$), and $\rho$ is the electrical conductance (% IACS), and wherein the cavity has its volume which is at most 30% of the volume of the mold body.

With the arrangement of the invention, in the Cu alloy for manufacturing the centrifugal casting mold, the higher the conductance, being related to the thermal conductivity, the smaller the increase in temperature of the surface of the cavity in the mold. Accordingly, since thermal stress is also small, a Cu alloy low in strength becomes difficult to be deformed. On the contrary, however, if a copper alloy low in conductance is used as a mold material, high strength is required because of high thermal stress. Thus, it is preferable that the copper alloy satisfying the above empirical equation (1) be employed as a material of the centrifugal casting mold.

As the specific copper alloys having a property or nature which satisfies the above equation (1), there are the following copper alloys and so on:

a Cu—Zr alloy,
a Cu—Cr—Zr alloy,
a Cu—Be alloy,
a Cu—Cr alloy, and
a Cu—Ag alloy.

These copper alloys are superior in tensile strength, and are relatively superior in conductance. Since the above copper alloys satisfy the above equation (1), when molten metal of the Ti or Ti alloy is centrifugally cost into the mold made of such an alloy, the surface of the cavity in the Cu-alloy mold, is heated instantaneously. Since, however the mold is superior in heat conduction, heat is conducted away in a short period of time and temperature of the cavity surface is reduced quickly. Thus, erosion loss or seizure of the cavity surface does not occur. If the volume of the cavity in the Cu-alloy mold becomes larger than 30% of the volume of the Cu-alloy mold body, the heat can be accumulated at a portion of the Cu-alloy mold. Thus, there may be a case where the mold becomes overheated so that thermal deformation or thermal breakage occurs. Accordingly, it is required that the volume of the cavity should be equal to or less than 30% of the volume of the mold body.

Thus, according to the invention, the use of the Cu-alloy mold, permits centrifugal casting of Ti or Ti-alloys with superior dimensional accuracy for a long period of time. Accordingly, it is possible to provide the Ti or Ti-alloy castings at cost lower than the conventional castings.

According to the invention, there is also provided a mold apparatus comprising:

at least two Cu-alloy molds for use in centrifugal casting of one of Ti and Ti-alloy, the molds being stacked vertically one upon the other, each of the molds being composed of a pair of upper and lower mold halves, each of the upper mold halves being capable of being split into a plurality of mold sections, each of the molds comprising a mold body having defined therein at least one cavity, wherein the mold body is made of a Cu alloy satisfying the following relationship:

$$Ts+0.3\rho \geqq 70$$

where

Ts is the tensile strength (kg/mm$^2$), and $\rho$ is the electrical conductance (% IACS), and wherein the cavity has its volume which is at most 30% of the volume of the mold body;

at least one spacer means interposed between the molds, the spacer means being capable of being split into a plurality of spacer sections; and means for fixing the molds and the spacer means to each other under such a condition that the molds and the spacer means are stacked one upon the other.

In order to practice casting by the mold apparatus according to the invention, the molds and the spacer means are first stacked one upon the other vertically, and are fixed to each other by the fixing means. Molten metal is poured into the cavity in each of the molds, to mold desirable castings.

In order to take out the products, the uppermost spacer means is divided to the right and left, and is drawn out of the mold apparatus.

By doing so, a space corresponding to the spacer means is created at a location below the lower mold half of the uppermost mold. The lower mold half is moved vertically by the utilization of the space. Thus, it is possible to remove the lower mold half from casting. As there is initially nothing at a location above the upper mold half of the uppermost mold, the upper mold half can freely be moved vertically upwardly, making it possible to easily remove the upper mold half from the casting.

The above-described operation is successively repeated, whereby it is possible to remove all the molds from the castings without breakage of the molds. Thus, castings are produced as in a tree similarly to the case of using the conventional ceramics molds.

As described above, according to the invention, even for the molds which are not disposed of after casting, the casting method can be applied so that the molds are stacked one upon the other vertically. Thus, it is made possible to cast articles in the form of a tree. This keeps the door open to mass-production of titanium-alloy castings, which employs the molds made of, for example, the copper alloy. Accordingly, the advantages of the mold apparatus according to the invention are extremely high.

According to the invention, there is further provided a method of manufacturing an engine valve head made of a titanium alloy, comprising the steps of:

meltings in a plasma-arc furnace a Ti alloy having its composition consisting of Al: 7 to 12 wt %, Sn: 0.5 to 5 wt %, Zr: 0.5 to 6 wt %, Mo: 0.5 to 5 wt %, and the remainder: Ti and unavoidable impurities; and preparing a permanent mold comprising a mold body having defined therein a cavity, the mold body being composed of a Cu alloy satisfying the following relationship:

$$Ts + 0.3\rho \geqq 70$$

where

Ts is the tensile strength (kg/mm$^2$), and $\rho$ is the electrical conductance (% IACS), and the cavity having its volume which is at most 30% of volume of the mold body; and centrifugally casting the melted Ti alloy in the permanent mold, to form the engine valve head.

With the above arrangement of the invention, the following advantages can be produced. That is, if the valve heads are manufactured by centrifugal casting in the permanent mold made of copper according to the invention, it is possible to manufacture the superior valve heads even if the alloy is more rich in Al content than the conventional titanium alloy. If the valve head is joined to a valve stem superior in processability, in a manner similar to the conventional one, it is possible to manufacture valves which are light in weight and which are superior. Thus, the method according to the invention can contribute to an increase in rotational speed of the engine.

DESCRIPTION OF THE EMBODIMENTS

Figure 1:
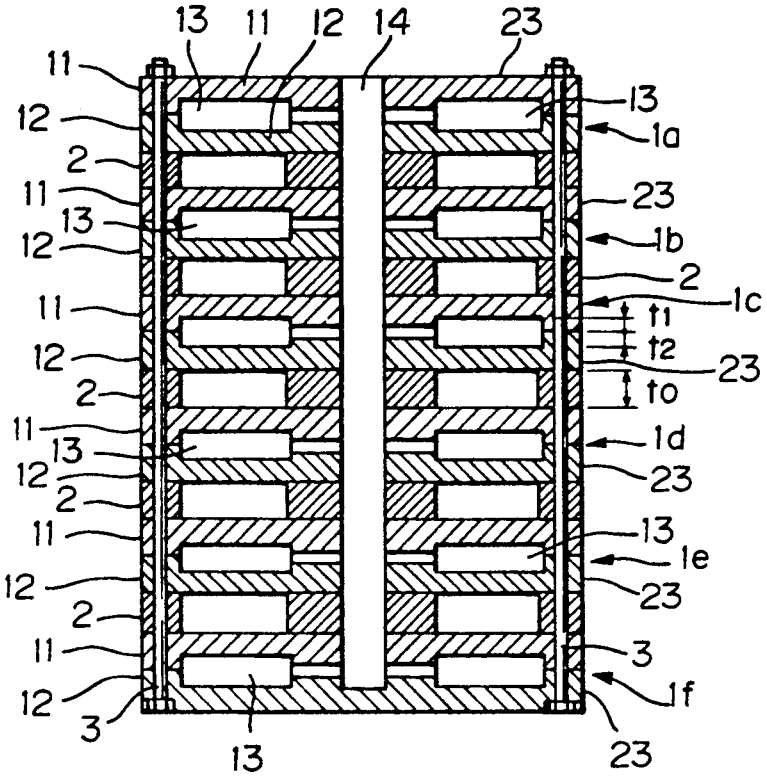
FIG. 1 is a longitudinal cross-sectional view of a mold apparatus according to an embodiment of the invention.

Various embodiments of the invention will be described in detail with reference to the drawings.

In view of the problems discussed in the aforesaid background of the invention, the inventors of the present application have conducted studies and researches in order to centrifugally cast Ti or Ti-alloy castings superior in dimensional accuracy, in quantities larger than, and in cost lower than the conventional castings. As a result, the following knowledge has been obtained:

(a) A centrifugal-casting mold is manufactured by the use of a Cu alloy which is superior in tensile strength and electrical conductance (mutually related to heat conduction), specifically, by the use of a Cu alloy which satisfies the following relationship:

$$Ts + 0.3\rho \geqq 70$$

where Ts is the tensile strength (kg/mm$^2$), and $\rho$ is the electrical conductance (% IACS), and (b) The centrifugal-casting mold has defined therein the cavity whose volume is equal to or less than 30% of the volume of the mold body, that is, the following relationship is satisfied:

$$\frac{\text{Volume of Cavity}}{\text{Volume of Mold Body}} \times 100 \leqq 30\%$$

By simultaneously satisfying the above conditions (a) and (b), it is possible to reuse the mold many times without incurring any of erosion, seizure and deformation of the surface of the Cu-alloy mold.

A centrifugal-casting mold was prepared which consisted of a Cu alloy whose component composition was illustrated in Examples 1 through 6 and Comparative Examples 1 through 7 in the table 1, and which had the indicated percentage of the cavity volume with respect to the volume of the mold body. The centrifugal-casting mold was set in a centrifugal casting apparatus which was located within a vacuum chamber. The centrifugal-casting mold was rotated at 500 r.p.m.

On the other hand, a Ti alloy was prepared whose composition consisted of Ti-6% Al-4% V (% is wt %). The Ti alloy was plasma-arc melted at 2000 A. The Ti alloy melt at 1750° C., was centrifugally cast in the centrifugal-casting mold which was rotated at 500 r.p.m.

The above-described centrifugal casting was repeated fifty (50) times. Subsequently, presence of erosion, seizure and deformation of the centrifugal-casting mold was observed. The results of the observation are shown in the below table 1.

TABLE 1

| Cu-ALLOY MOLD |
|---|

TABLE 1-continued

| TYPE | COMPONENT COMPOSITION AND CHARACTERISTICS OF Cu ALLOY: COMPONENT COMPOSITION (wt %) | TENSILE STRENGTH Ts (kg/mm²) | CONDUCTANCE (% IACS) | VALUE OF Ts + 0.3ρ | VOLUME OF CAVITY / VOLUME OF MOLD BODY × 100 (%) | OBSERVATION RESULTS OF Cu-ALLOY MOLD AFTER HAVING BEEN CENTRIFUGALLY CAST FIFTY (50) TIMES: MELTING LOSS | SEIZURE | DEFORMATION |
|---|---|---|---|---|---|---|---|---|
| EXAMPLES | | | | | | | | |
| 1 | Cu-02%-Zr | 50 | 90 | 77 | 20 | NONE | NONE | NONE |
| 2 | Cu-0.9% Cr-0.2% Zr | 63 | 80 | 87 | 25 | " | " | " |
| 3 | Cu-2% Be-0.3% Co | 130 | 20 | 136 | 30 | " | " | " |
| 4 | Cu-1% Cr | 55 | 85 | 81 | 20 | " | " | " |
| 5 | Cu-1% Ag | 45 | 98 | 74 | 10 | " | " | " |
| 6 | Cu-0.5% Be-2.5% Co | 90 | 48 | 112 | 30 | " | " | " |
| COMPARATIVE EXAMPLES | | | | | | | | |
| 1 | PURE COPPER | 30 | 100 | 60* | 30 | NONE | NONE | PRESENCE |
| 2 | Cu-8% Sn-0.2% P | 62 | 13 | 65.9* | 25 | PRESENCE | PRESENCE | PRESENCE |
| 3 | Cu-0.2% Zr | 50 | 90 | 77 | 40* | NONE | NONE | PRESENCE |
| 4 | Cu-1% Cr | 55 | 85 | 81 | 50* | NONE | NONE | PRESENCE |
| 5 | Cu-8% Al | 46 | 15 | 51* | 20 | PRESENCE | PRESENCE | PRESENCE |
| 6 | Cu-18% Ni | 40 | 6 | 42* | 20 | PRESENCE | PRESENCE | PRESENCE |
| 7 | Cu-10% Zn | 30 | 44 | 44* | 10 | NONE | PRESENCE | PRESENCE |

(THE MARKS * INDICATE VALUES OUT OF CONDITION OF THE INVENTION)

As will be clear from the results in table 1, the centrifugal-casting mold made of the Cu alloy, which satisfies the condition according to the invention, does not cause melting loss, seizure and deformation to occur even after having centrifugally cast the Ti alloy fifty (50) times. However, at least one of the erosion, seizure and deformation problems occurs in the centrifugal casing mold which is made of a Cu alloy, which does not satisfy the equation (1) referred to in the aforementioned background of the invention, under the condition according to the invention. Further, as will be clear from the Comparative Examples 3 and 4, even in the mold made of the copper alloy satisfying the above-mentioned equation (1), if the volume of the cavity exceeds 30% of the volume of the mold body, deformation will occur in the mold. This is not desirable.

Referring to FIG. 1, there is shown, in a longitudinal cross-sectional view, a mold apparatus according to an embodiment of the invention. In this connection, the mold apparatus comprises a plurality of molds each of which is similar in construction to the mold described previously. Thus, the description of the molds will be omitted.

As shown in FIG. 1, a plurality of molds 1*a* through 1*f* is stacked one upon the other vertically. A spacer 2 is interposed between each pair of adjacent molds. A plurality of, four (4) in the illustrated embodiment, bolts 3 is passed through peripheries of the molds 1*a* through 1*f* and the spacers 2. By the bolts 3, the molds 1*a* through 1*f* and the spacers 2 are fixed together under such a condition that the molds and the spacers 2 are alternately stacked one upon the other vertically.

Figure 2:
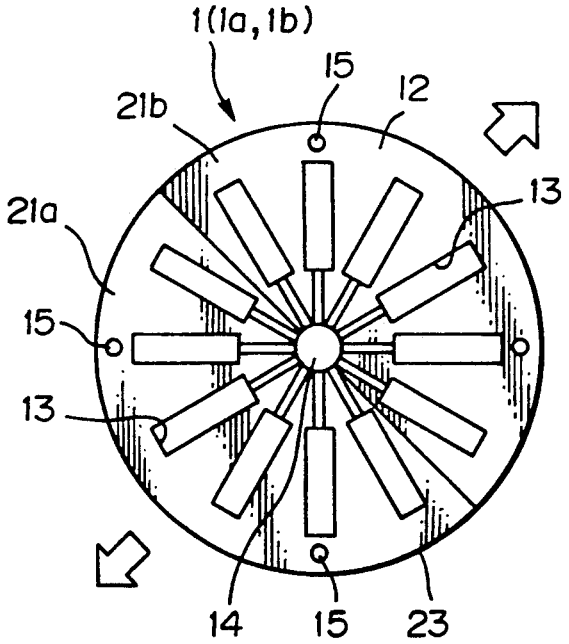
FIG. 2 is a top plan view of one of a plurality of molds illustrated in FIG. 1.

Each of the molds 1*a* through 1*f* is composed of two mold halves 11 and 12 which are stacked one upon the other. As illustrated in FIG. 2, the mold is capable of being split into a plurality of, two in the illustrated embodiment, mold sections 21*a* and 21*b* which are substantially identical in dimension with each other. The mold has a disc-like configuration in plan, for example. The mold comprises a mold body 23 which has defined therein at least one, twelve (12) in the illustrated embodiment, cavity 13 for forming an engine valve head for a vehicle. That is, the mold body 23 of each of the molds 1*a* through 1*f* has defined therein the plurality of cavities 13 which extend radially and which are spaced radially from each other through a predetermined angle.

In connection with the above, each of the intermediate molds 1*a* through 1*f* and the uppermost mold 1*a* are formed therein with respective through bores 14 for a sprue runner. The through bores 14 communicate with the cavities 13. The through bore for the sprue runner is not required for the lower mold half 12 of the lowermost mold 1*f*, and a normal or usual lower mold half is utilized for the lower mold half 12 of the lowermost mold 1*f*.

Figure 3:
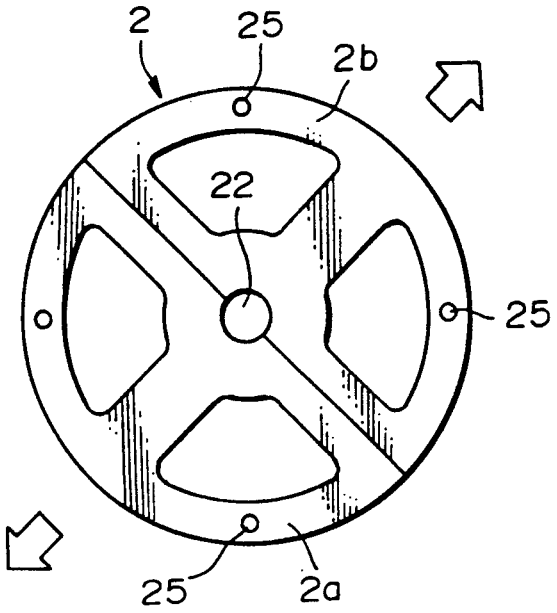
FIG. 3 is a top plan view of one of a plurality of spacers illustrated in FIG. 1.
Figure 4:
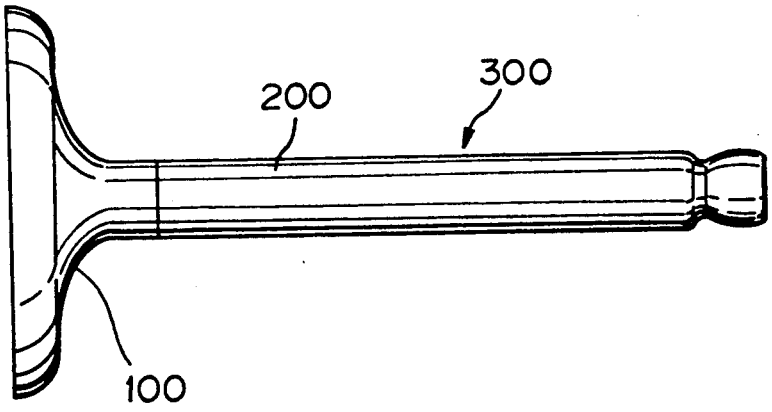
FIG. 4 is a side view for explanation of construction of the conventional engine valve made of a titanium alloy.

Each of the spacers 2 is interposed between a corresponding pair of adjacent molds. The spacer 2 is identical in configuration in plan with the mold. The mold and the spacer 2 are substantially identical in diameter with each other. The spacer 2 is capable of being split into a plurality of, two (2) in the illustrated embodiment, spacer sections 2*a* and 2*b* which are substantially identical in dimension with each other, as illustrated in FIG. 3. The spacer 2 is formed with a through bore 22 for a sprue runner, which extends through a central portion of the spacer 2.

The spacer 2 has its thickness slightly larger than that of the cavity 13. Specifically, the thickness $t_0$ of the spacer 2 is set to a value slightly larger than the thickness $(t_1+t_2)$ of the cavity 13 in the upper and lower mold halves 11 and 12 of the mold, such that, after the spacer 2 has been drawn out of the mold apparatus under the assembled condition to form a space, the upper mold half 11 or the lower mold half 12 of the mold is moved upwardly or downwardly by the utilization of the space so that the right and left mold sections 21*a* and 21*b* of the upper or lower mold half 11 or 12 can easily be drawn to the left and right.

In connection with the above, the molds 1*a* through 1*f* and the spacers 2 are formed therein with a plurality of bolt inserting bores 15 and 25, respectively, as shown in FIGS. 2 and 3, through which the connecting bolts 3 are inserted.

The case where the valve head is cast by the aformentioned mold apparatus will next be described.

First, the mold apparatus shown in FIG. 1 is manufactured. Specifically, the mold 1*f*, which is usually employed at the lowermost layer, is first installed. Subsequently, the spacer 2 is stacked upon the upper face of the lowermost mold 1*f*. The mold 1*e* having the through bore 14 for the sprue runner is stacked upon the upper face of the spacer 2. The procedure is repeated to alternately stack the molds 1*d* to 1*a* and the spacers 2 one upon the other. Lastly, the fastening bolts 3 are inserted through the stacked molds 1*a* through 1*f* and spacers 2 and are tightened by nuts so that the molds 1*a* through 1*f* and the spacers 2 are connected to each other and are united together.

In the thus assembled mold apparatus, molten metal of the titanium alloy is poured into and flowed through the through bores 14 and 22 for the sprue runner, and the mold apparatus is rotated on a rotating table within a casting furnace, to centrifugally cast titanium-alloy products.

After cooling, the mold apparatus is removed out of the casting furnace. The bolts 3 are removed from the stacked molds 1*a* through 1*f* and spacers 2. The upper mold half 11 of the uppermost mold 1*a* is moved upwardly and is removed from the lower mold half 12 of the uppermost mold 1*a*.

Subsequently, the spacer sections 2*a* and 2*b* of the uppermost spacer 2 are moved to the left and the right horizontally, and are drawn out of the remaining molds 1*b* through 1*f* and spacers 2.

By doing so, a space corresponding to the drawn spacer 2 occurs at a location below the uppermost mold 1*a*. Thus, it is possible to move the lower mold half 12 of the uppermost mold 1*a* downwardly to remove the lower mold 12 from the casting. Subsequently, the pair of mold sections 21*a* and 21*b* of the lower mold 12 are also moved to the left and right, and are drawn horizontally from the casting.

The above-described procedure is repeated, and the lowermost mold 1*f* is removed from the casting. Thus, similarly to the case of using the ceramics molds, it is possible to produce an intermediate casting article in the form of a tree.

In connection with the above, in the above-mentioned embodiment, the number of the molds should not be limited to six (6) as in the illustrated embodiment, but any number of the molds can be used.

Apart from the above, the inventors of this application have conducted studies and researches to produce a valve head for an engine value made of a titanium alloy superior in mechanical properties at the normal and high temperature, particularly, superior in shock resistance at the normal temperature, by the use of a titanium alloy rich in Al content more than the conventional one. As a result, the following knowledge has been obtained. That is, a Ti alloy having the following composition is first prepared:

Al: 7 to 12 wt %,
Sn: 0.5 to 5 wt %,
Zr: 0.5 to 6 wt %,
Mo: 0.5 to 5 wt %, and
the remainder: Ti and unavoidable impurities.

The above-mentioned Ti alloy is plasma-arc melted. Subsequently, a permanent mold is prepared which is idenitcal with the mold described previously, and the description of the mold will be omitted. Subsequently, the dissolved Ti alloy is centrifugally cast in the copper permanent mold, to form the engine valve head. The cast engine valve head has $\beta$ particles whose mean particle size is equal to or less than 150 $\mu$m, and an $\alpha$ phase of Ti Al which is finely precipitated in the microstructure of the valve head. Thus, it is possible to produce the valve head for the engine valve made of the titanium alloy superior in mechanical properties at the normal and high temperatures, particulaly, superior in shock resistance at the normal temperature.

In this case, even of the Ti alloy containing 7 to 12 wt % of Al is centrifugally cast in a mold made of graphite, the mean particle size of the $\beta$ particles becomes equal to or larger than 200 $\mu$m. Further, $Ti_3Al$ in the $\alpha_2$ phase is not pulverized or is not brought to fine particles. Thus, the mechanical properties at the normal temperature, particularly, elongation is not improved. Accordingly, shock resistance at the normal temperature is not improved. For this reason, it is essential for the invention to centrifugally cast the above-mentioned Ti alloy in the permanent mold made of Cu.

Limiting reasons of the component composition of the titanium alloy used in the invention are as follows:

(1) Al

Al component has such an effect of strengthening or reinforcing the $\alpha$ phase to increase high-temperature strength. If, however, the content of the Al component is less than 7 wt %, it is impossible to maintain or retain the high-temperature strength to a desirable value. On the other hand, if the Al component is contained in excess of 12 wt %, elongation at the normal temperature is deteriorated, and the fluidity is also deteriorated.

Accordingly, the Al content is limited to 7 to 12 wt %

(2) Sn

Sn component has such an action as to reinforce the $\alpha$ phase to increase the high-temperature strength. If, however, the content of the Sn component is less than 0.5 wt %, there cannot be produced sufficient advantages. On the other hand, if the Sn component is contained in excess of 5 wt %, elongation at the normal temperature is deteriorated, and the fluidity is also deteriorated.

Accordingly, the Sn content is limited to 0.5 to 5 wt %.

(3) Zr

Zr component has such an action as to strengthen or reinforce the $\alpha$ phase to increase high-temperature strength. If, however, the content of the Zr component is less than 0.5 wt %, there cannot be produced sufficient advantages. On the other hand, if the Zr component is contained in excess of 6 wt %, elongation at the normal temperature is deteriorated, and the fluidity is also deteriorated.

Accordingly, the Zr content is limited to 0.5 to 6 wt %.

(4) Mo

Mo component has such an action as to strengthen or reinforce the $\beta$ phase to increase high-temperature strength. If, however, the content of the Mo component is less than 0.5 wt %, there cannot be produced sufficient advantages. On the other hand, it is not preferable that, if the Mo component is contained in excess of 5 wt %, the $\beta$ transformation temperature and the high-temperature creep strength are reduced, and the fluidity is deteriorated.

Accordingly, the Mo content is limited to 0.5 to 5 wt %.

(5) Impurities

Here, the unavoidable impurities include Fe, O, C, N, H and the like. It is preferable, however, that the unavoidable impurities have the following contents:

Fe $\leqq$0.30 wt %,
O $\leqq$0.3 wt %,
C $\leqq$0.1 wt %,
N $\leqq$0.1 wt %, and
H $\leqq$0.02 wt %.

The invention will next be described specifically on the basis of various examples.

A Ti alloy was arc-skull-dissolved under vacuum as a consumable electrode. The dissolved molten Ti alloy was centrifugally cast in a mold made of copper and a mold made of graphite, to manufacture test pieces of Examples 11 through 16,test pieces of Comparative Examples 11 through 17 and test pieces of the conventional example. Mechanical properties of the test pieces were measured regarding tensile strength at the normal temperature, tensile strength at the high temperature of 800° C., 0.2% proof stress and elongation. The results of the measurements are shown in the table 2.

TABLE 2

| TYPE | COMPONENT COMPOSITION (wt %) Al | Sn | Zr | Mo | Ti AND UNAVOIDABLE IMPURITIES | MATERIAL OF MOLD | MECHANICAL PROPERTY AT NORMAL TEMPERATURE TENSILE STRENGTH (kg/mm²) | 0.2% PROOF STRESS (kg/mm²) | ELONGATION (%) |
|---|---|---|---|---|---|---|---|---|---|
| EXAMPLE 11 | 11.8 | 3.0 | 3.0 | 4.8 | REMAINDER | COPPER | 100 | 96 | 2.2 |
| COMPARATIVE EXAMPLE 11 | | | | | | GRAPHITE* | 98 | 93 | 0.1 |
| EXAMPLE 12 | 11.5 | 0.8 | 1.5 | 3.0 | REMAINDER | COPPER | 101 | 93 | 2.1 |
| COMPARATIVE EXAMPLE 12 | | | | | | GRAPHITE* | 98 | 94 | 0.1 |
| EXAMPLE 13 | 10.0 | 1.8 | 3.9 | 2.1 | REMAINDER | COPPER | 98 | 92 | 2.3 |
| COMPARATIVE EXAMPLE 13 | | | | | | GRAPHITE* | 96 | 90 | 0.1 |
| EXAMPLE 14 | 9.5 | 4.5 | 0.7 | 0.8 | REMAINDER | COPPER | 99 | 88 | 2.2 |
| COMPARATIVE EXAMPLE 14 | | | | | | GRAPHITE* | 98 | 85 | 0.3 |
| EXAMPLE 15 | 8.8 | 1.0 | 5.5 | 1.5 | REMAINDER | COPPER | 95 | 87 | 2.5 |
| COMPARATIVE EXAMPLE 15 | | | | | | GRAPHITE* | 92 | 84 | 0.3 |
| EXAMPLE 16 | 7.5 | 0.9 | 2.0 | 1.8 | REMAINDER | COPPER | 91 | 84 | 2.7 |
| COMPARATIVE EXAMPLE 16 | | | | | | GRAPHITE* | 88 | 82 | 0.2 |
| COMPARATIVE EXAMPLE 17 | 13.0* | 3.0 | 3.0 | 4.8 | REMAINDER | COPPER | 94 | 86 | 0.5 |
| CONVENTIONAL EXAMPLE | 6.1 | 1.9 | 4.1 | 2.1 | Si: 0.09 REMAINDER | GRAPHITE | 93 | 87 | 5.0 |

| TYPE | MECHANICAL PROPERTY AT 800° C. TENSILE STRENGTH (kg/mm²) | 0.2% PROOF STRESS (kg/mm²) | ELONGATION (%) |
|---|---|---|---|
| EXAMPLE 11 | 65 | 58 | 4.0 |
| COMPARATIVE EXAMPLE 11 | 65 | 57 | 3.5 |
| EXAMPLE 12 | 62 | 55 | 3.8 |
| COMPARATIVE EXAMPLE 12 | 61 | 53 | 3.1 |
| EXAMPLE 13 | 58 | 51 | 4.1 |
| COMPARATIVE EXAMPLE 13 | 57 | 51 | 3.2 |
| EXAMPLE 14 | 60 | 55 | 3.2 |
| COMPARATIVE EXAMPLE 14 | 58 | 52 | 3.8 |
| EXAMPLE 15 | 58 | 52 | 3.5 |
| COMPARATIVE EXAMPLE 15 | 56 | 50 | 3.5 |
| EXAMPLE 16 | 55 | 50 | 4.5 |
| COMPARATIVE EXAMPLE 16 | 53 | 49 | 3.9 |
| COMPARATIVE EXAMPLE 17 | 54 | 49 | 4.0 |
| CONVENTIONAL EXAMPLE | 4.0 | 35 | 30.0 |

(THE MARKS * INDICATE VALUES OUT OF CONDITION OF THE INVENTION)

From the results of the table 2, any of the test pieces of the Examples 11 through 16, which are manufactured by the manufacturing method according to the invention, are superior in tensile strength at the normal temperature, tensile strength at the high temperature and 0.2% proof stress. Regarding the elongation, the test pieces of the Examples 11 through 16 are considerably less than the test pieces of the conventional example. In view of the fact that the elongation is larger than elongation (2%) required for the shock resistance at the normal temperature of the engine valve head, however, it will be seen that there is no problem in practical use.

Furthermore, the test pieces of the Comparative Examples 11 through 16, which are produced by centrifugal casting of the Ti alloy according to the invention, in the mold made of graphite, are remarkably reduced in elongation, particularly, at the normal temperature. Accordingly, it is known that the test pieces of the Comparative Examples 11 through 16 cannot be used as the engine valve heads. This is due to the fact that, if centrifugal casting is made in the graphite mold, the $\beta$ phase of the structure of the Ti alloy and the $Ti_3Al$ phase in the $\alpha_2$ phase are excessively grown and are roughened so that the mean particle size of the $\beta$ phase exceeds 200 $\mu$m.

Moreover, even if centrifugal casting is made within the mold made of copper, should the Al content contained in the Ti alloy be higher than 12% according to the invention, the elongation at the normal temperature is less than 2% as will be seen in the test piece of the Comparative Example 17. Thus, it will be seen that this Ti alloy is not suitable for manufacturing of the engine valve head even if it is cast by the method presented in this invention.

What is claimed is:

1. A Cu-alloy mold for use in centrifugal casting of one of Ti and Ti-alloy, comprising a mold body having defined therein a cavity, wherein said mold body is made of a Cu alloy satisfying the following relationship:

$$Ts+0.3\rho \geqq 70$$

where Ts is the tensile strength (kg/mm$^2$), and $\rho$ is the electrical conductance (% IACS), and wherein said cavity has its volume which is at most 30% of the volume of said mold body.

2. The Cu-alloy mold according to claim 1, wherein said mold body is made of one alloy selected from a group consisting of a Cu-Zr alloy, a Cu-Cr-Zr alloy, a Cu-Be alloy, a Cu-Cr alloy and a Cu-Ag alloy.

3. The Cu-alloy mold according to claim 1, wherein said mold body is made of one alloy selected from a group consisting of a Cu-0.2%-Zr alloy, a Cu-0.9% Cr-0.2% Zr alloy, a Cu-2% Be-0.3% Co alloy, a Cu-1% Cr alloy, a Cu-1% Ag alloy and a Cu-0.5%Be-2.5%Co alloy.

4. A method of centrifugally casting one of Ti and Ti-alloy by the use of a Cu-alloy mold which comprises a mold body having defined therein a cavity, wherein said mold body is made of a Cu alloy satisfying the following relationship:

$$Ts+0.3\rho \geqq 70$$

where Ts is the tensile strength (kg/mm$^2$), and $\rho$ is the electrical conductance (% IACS), and wherein said cavity has its volume which is at most 30% of the volume of said mold body.

5. A method of centrifugally casting according to claim 4, wherein said mold body is made of one alloy selected from a group consisting of a Cu—Zr alloy, a Cu—Cr—Zr alloy, a Cu—Be alloy, a Cu—Cr alloy and a Cu—Ag alloy.

6. A method of centrifugally casting according to claim 4, wherein said mold body is made of one alloy selected from a group consisting of a Cu-0.2%-Zr alloy, a Cu-0.9% Cr-0.2% Zr alloy, a Cu-2% Be-0.3% Co alloy, a Cu-1% Cr alloy, a Cu-1% Ag alloy and a Cu-0.5% Be-2.5% Co alloy.

7. A mold apparatus comprising:

at least two Cu-alloy molds for use in centrifugal casting of one of Ti and Ti-alloy, said molds being stacked vertically one upon the other, each of said molds being composed of upper and lower mold halves, each of the upper and lower mold halves being capable of being split into a plurality of mold sections, each of said molds comprising a mold body having defined therein at least one cavity, wherein said mold body is made of a Cu alloy satisfying the following relationship:

$$Ts+0.3\rho \geqq 70$$

where Ts is the tensile strength (kg/mm$^2$), and $\rho$ is the electrical conductance (% IACS), and wherein said cavity has its volume which is at most 30% of volume of said mold body;

at least one spacer means interposed between said molds, said spacer means being capable of being split into a plurality of spacer sections; and means for fixing said molds and said spacer means relative to each other such that said molds and said spacer means are stacked one upon the other.

8. The mold apparatus according to claim 7, wherein each of the upper and lower mold halves of each of said molds is capable of being split into two mold sections substantially identical in dimension with each other, and said spacer means is capable of being split into two spacer sections substantially identical in dimension with each other.

9. The mold apparatus according to claim 7, wherein the mold body of each of said molds has defined therein a plurality of cavities which extend radially and which are spaced radially from each other through a predetermined angle.

10. The mold apparatus according to claim 7, wherein each of said molds has a disc-like configuration in plan, and said spacer means is identical in configuration in plan with the mold, and wherein the mold and said spacer means are substantially identical in diameter with each other.

11. The mold apparatus according to claim 7, wherein said spacer means has a thickness which is slightly larger than that of said cavity.

12. A method of manufacturing an engine valve head made of a titanium alloy, comprising the steps of:

melting a Ti alloy having a composition consisting of

Al: 7 to 12 wt %,

Sn: 0.5 to 5 wt %,

Zr: 0.5 to 6 wt %,

Mo: 0.5 to 5 wt %, and the remainder: Ti and unavoidable impurities; and preparing a permanent mold comprising a mold body having defined therein a cavity, said mold body being made of a Cu alloy satifying the following relationship:

$$Ts+0.3\rho \geqq 70$$

where Ts is the tensile strength (kg/mm$^2$), and $\rho$ is the electrical conductance (% IACS), and said cavity having a volume which is at most 30% of the volume of said mold body; and centrifugally casting said dissolved Ti alloy in said permanent mold, to form said engine valve head.

13. The method according to claim 12, wherein said engine valve head has $\beta$ particles whose mean particle size is at most equal to 150 $\mu$m, and an $\alpha_2$ phase of $Ti_3Al$ which is precipitated in the structure of said valve head.

14. The method according to claim 12, wherein said unavoidable impurities include Fe, O, C, N and H.

15. The method according to claim 13, wherein said unavoidable impurities have the following amounts:

$Fe \leqq 0.30$ wt %, $O \leqq 0.3$ wt %, $C \leqq 0.1$ wt %, $N \leqq 0.1$ wt %, and $H \leqq 0.02$ wt %.

* * * * *